US005598954A

United States Patent [19]

Salzano

[11] Patent Number: 5,598,954

[45] Date of Patent: Feb. 4, 1997

[54] DOOR ACTUATED DEVICE FOR DISPENSING FLUID FROM A CONTAINER

[76] Inventor: Vincenzo Salzano, 68 Showground Road, Castle Hill NSW 2154, Australia

[21] Appl. No.: 411,586

[22] Filed: Mar. 29, 1995

[30] Foreign Application Priority Data

Mar. 30, 1994 [AU] Australia ..... 59192/94

[51] Int. Cl.[6] ..... B67D 5/00

[52] U.S. Cl. ..... 222/162; 222/180; 222/183; 239/274

[58] Field of Search ..... 222/160, 162, 222/180, 183, 321.7, 321.9; 239/274

[56] References Cited

U.S. PATENT DOCUMENTS

| | | | |
|---|---|---|---|
| 2,534,465 | 12/1950 | Marini | 239/274 |
| 2,921,435 | 1/1958 | Wenner | 239/274 |
| 4,579,261 | 4/1986 | Arabian et al. | 222/180 X |
| 5,016,781 | 5/1991 | Wolde | 222/162 |
| 5,390,833 | 2/1995 | Baumann | 222/180 X |

FOREIGN PATENT DOCUMENTS

| | | | |
|---|---|---|---|
| 553911 | 1/1984 | Australia . | |
| 72012/81 | 9/1986 | Australia . | |
| 1309928 | 10/1972 | France | 239/274 |

*Primary Examiner*—Kevin P. Shaver
*Attorney, Agent, or Firm*—Davis and Bujold

[57] ABSTRACT

A door actuated device for dispensing fluid from a container which comprises a holder having a plunger assembly adapted to receive a container. The container has a dispensing valve and contains a deodorizing fluid, a disinfectant or a perfumed liquid which is dispensed from the device into a room when the dispensing valve is actuated by the plunger assembly of the holder upon opening or closing of a door.

19 Claims, 8 Drawing Sheets

DOOR ACTUATED DEVICE FOR DISPENSING FLUID FROM A CONTAINER

FIELD OF THE INVENTION

The present invention relates to a door actuated device for dispensing fluid from a container. More specifically, the invention relates to a device comprising a holder having a plunger assembly and being adapted to receive a container. The container has dispensing valve means and contains a deodorising fluid, a disinfectant or a perfumed liquid which is dispensed from the device into a room when the dispensing valve means is actuated by the plunger assembly of the holder upon opening and/or closing of a door.

BACKGROUND OF THE INVENTION

Devices for alleviating undesirable odours have been used in toilet environments and ocher room areas where such odours may occur.

For example, AU 553911 discloses a device comprising a wall mountable holder adapted to receive a pressurised aerosol can. The holder consists of a housing with a pivotally mounted cover having a fixed valve actuating member formed to engage with a valve stem of the aerosol can. In use, the cover is pressed by hand causing the valve stem to be depressed by the valve actuating member and fluid to be dispensed from the aerosol can.

AU 72012/81 discloses an aerosol can being positioned in a holder mounted to a door of a room where upon opening of the door and interaction of the press button of the aerosol can with a swinging lever fixed to the door architrave a fluid mist is delivered from the aerosol can to the surrounding area.

Environmental awareness has in recent years led to replacing pressurised aerosol cans using fluorhydrocarbons with unpressurised liquid containers or bottles from which fluid can be dispensed using a pump-valve system instead of a propellant gas.

A simple robust door actuated device for dispensing deodorisers, disinfectants or other fluids which could be used with different types of doors, particularly swinging and sliding type doors would be beneficial and enable costs to manufacturers to be kept to a minimum.

SUMMARY OF THE INVENTION

In a first aspect of the present invention there is provided a door actuated device for dispensing a fluid from a container, comprising:

a holder receiving the container and being mountable to a door or a structure adjacent to the door; and a plunger assembly for actuating a dispensing means of the container and being displaceable between first and second positions relative to the container, the plunger assembly having a longitudinal axis and contact means arranged to be able to contact a foreign surface when the door is opened and/or closed and so cause the plunger assembly to be displaced;

wherein the holder has guide means for guiding the plunger assembly between the first and second positions and the fluid is dispensed from the container by the dispensing means through a nozzle on the plunger assembly when the plunger assembly is displaced by the contact of the contact means with the foreign surface, and wherein the plunger assembly is able to be slidably received by the guiding means of the holder in a plurality of different rotational positions obtainable by rotating the plunger assembly about the longitudinal axis.

In embodiments of the present invention the contact means of the plunger assembly is able to be orientated in any one of number of possible directions by rotating the plunger assembly between the different rotational positions thereby allowing the contact means to be properly orientated for contact with the foreign surface when the door is opened and/or closed. By being able to orientate the contact means in a number of different directions a single device can be used with different door types such as conventional swinging doors or, for example, sliding doors.

As sliding doors are moved within a plane when they are being opened and closed while conventional swinging doors are swung about an axis of rotation, embodiments of the present invention are provided wherein the contact means is able to be rotated through 90° when the plunger assembly is rotated from a first rotational position to a second rotational position.

The contact means may, for instance, be an engagement roller rotatably mounted on an end portion of the plunger assembly. Alternatively, the contact means may comprise a contact rod connected to the plunger assembly through a linkage arrangement.

The foreign surface may be an inclined surface of a ramp fitting mounted on a structure adjacent to the door such as the door frame or door guide rail. However, the foreign surface could be a surface of the door or a wall located adjacent to the door.

In a preferred embodiment the plunger assembly is comprised of a plunger body and a press button which is received in a cavity of the plunger body. The nozzle is located on the press button and the plunger body is able to be rotated between the different rotational positions relative to the press button to thereby allow the fluid dispensing device to be adapted for use on different door types while at the same time the direction in which the fluid is dispensed from the device relative to the holder is able to be maintained.

However, embodiments may be provided wherein the press button is not present. In this instance, the nozzle may be located on the plunger body and be in fluid communication with a valve stem of the dispensing means of the container through a duct formed in the plunger body. If desired the nozzle can be formed so as to be substantially coaxial with the longitudinal axis of the plunger assembly. Alternatively, the nozzle may extend at an angle with respect to the longitudinal axis thereby allowing the direction in which the fluid is dispensed from the container to be changed when the plunger assembly is rotated from one rotational position to another.

Preferably, the plunger body has a square-shaped cross-section lying in a plane substantially perpendicular to the longitudinal axis.

In a preferred embodiment, the holder is a casing adapted to receive and enclose the container such that the engagement means of the plunger assembly protrudes through an opening in the casing.

The container may be of any conventional type having dispensing means able to be operated when pressed. While it is preferable that the container is an unpressurised container having a conventional pump action type valve mechanism it will be appreciated that pressurised aerosol cans may also be utilised in embodiments of the present invention.

It is an advantage that dispensing devices embodied by the present invention can be used with different door types thereby allowing costs to manufacturers to be kept to a minimum. It is a further advantage that the present invention may provide a fluid dispensing device having a simple but robust design.

The present invention will hereinafter be described with reference to preferred, non-limiting embodiments of the present invention illustrated in the accompanying drawings.

DETAILED DESCRIPTION OF PREFERRED EMBODIMENTS OF THE INVENTION

Figure 1:
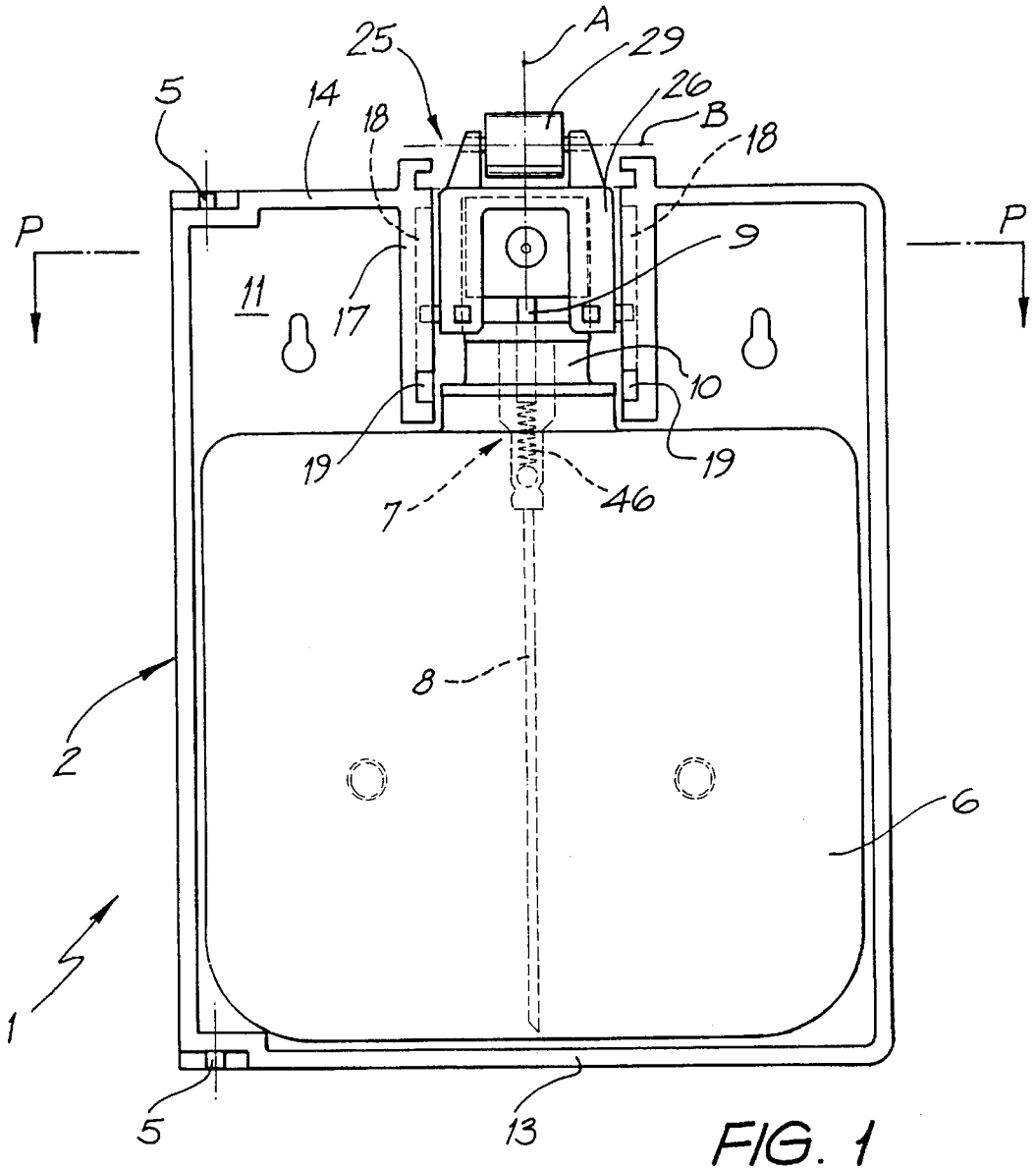
FIG. 1 is a side view of a door actuated device for dispensing fluid embodied by the present. The cover of the holder is not shown.
Figure 2:
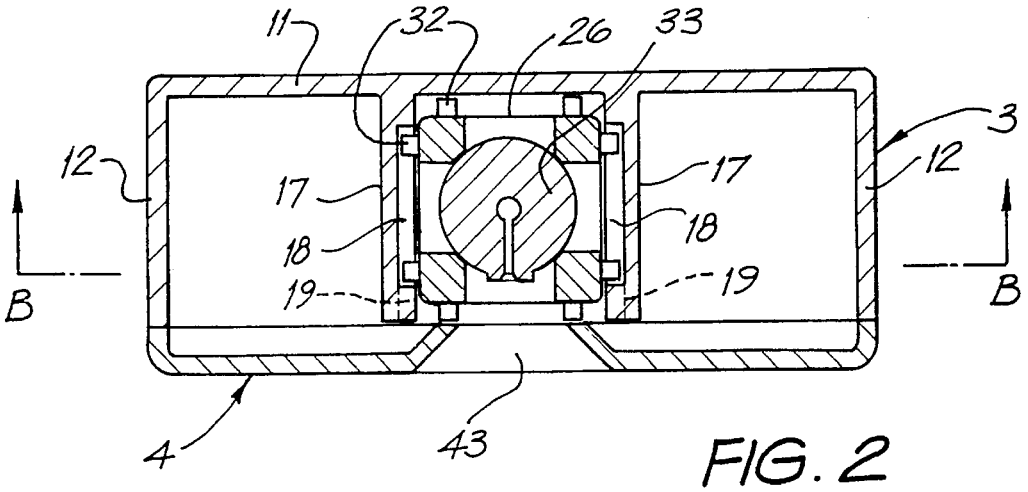
FIG. 2 is a cross-sectional view taken along line P—P of FIG. 1.
Figure 3:
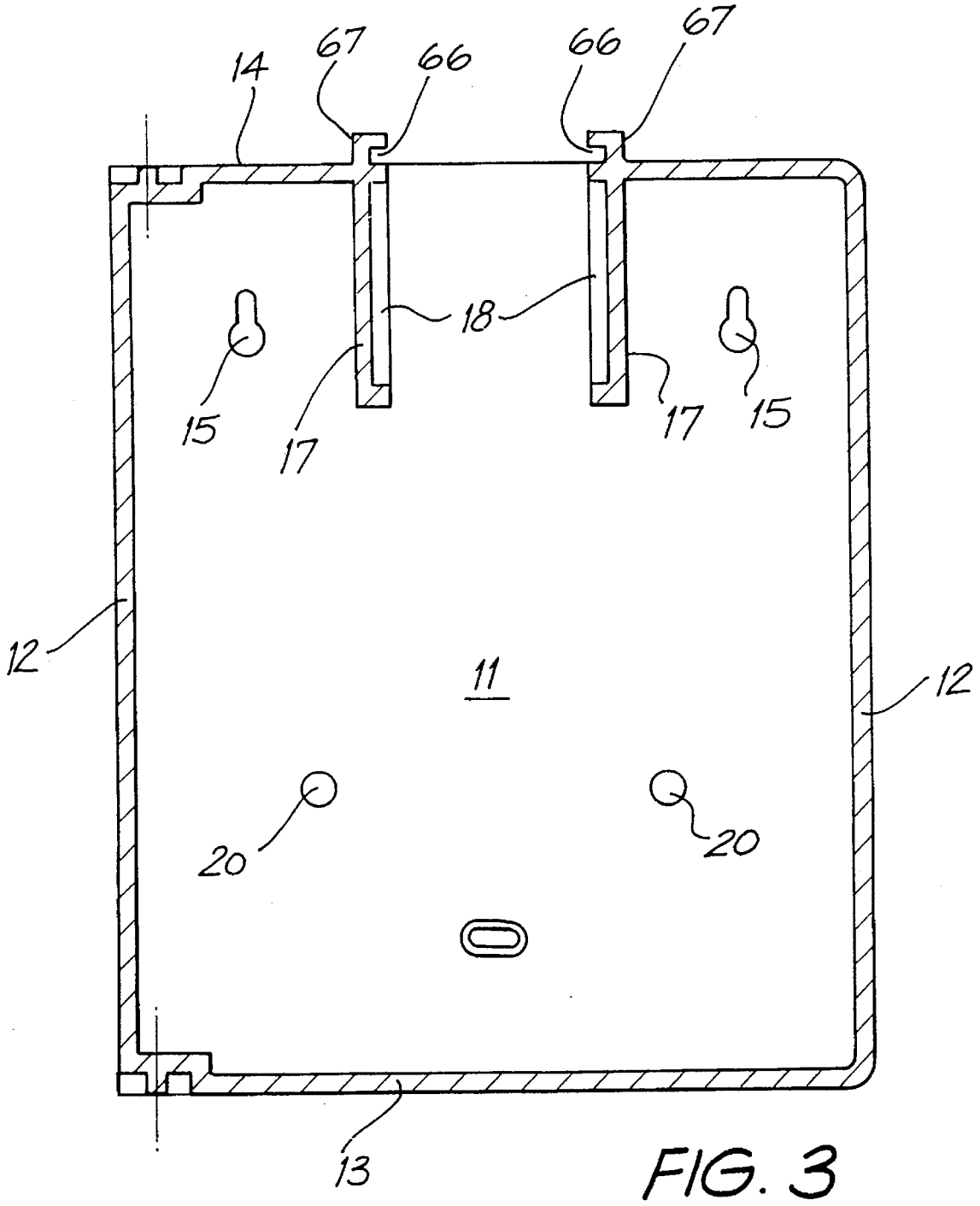
FIG. 3 is a cross-sectional view taken along line B—B of FIG. 2.

Turning first to FIGS. 1 to 3 there is depicted a door actuated device 1 having a holder in the form of a casing 2 comprising a casing body 3 mountable to a door or a building structure and a cover 4. Cover 4 is pivotally attached to casing body 3 by means of pivot pins 5.

Casing body 3 receives and encloses a container 6 with a dispensing valve assembly 7 consisting of a conventional pump action valve mechanism. Dispensing valve assembly 7 comprises a conduit 8 and a displaceable valve stem 9 protruding through sealed neck 10 of container 6. Conduit 8 extends into the lower part of container 6 to allow dispensing of the fluid contained therein upon actuation of dispensing valve assembly 7.

As can be seen from FIGS. 2 and 3, the casing body 3 has one back wall 11, a pair of side walls 12, and bottom and top walls 13, 14. Back wall 11 is provided with mounting holes 15 for fixing casing body 3 to the door or building structure while top wall 14 is provided with a central opening 16.

Protruding from top wall 14 into casing body 3 are two planar guide walls 17 which are substantially parallel to one another. The inner surface of each guide wall 17 is provided with a pair of parallel extending guide grooves 18 which extend from a lower position near the free end of each guide wall 17 to an upper position adjacent to opening 16. Each guide wall 17 is also provided with insertion grooves 19 near the lower free ends thereof which extend perpendicularly to and intersect guide grooves 18.

Back wall 11 of casing body 3 can also be provided with support protrusions 20 as shown which are adapted to be received in corresponding depressions of the container 6 in order to secure the container within casing body 3. As shown in FIG. 1, neck 10 of container 6 lies between planar guide walls 17.

Figure 4:
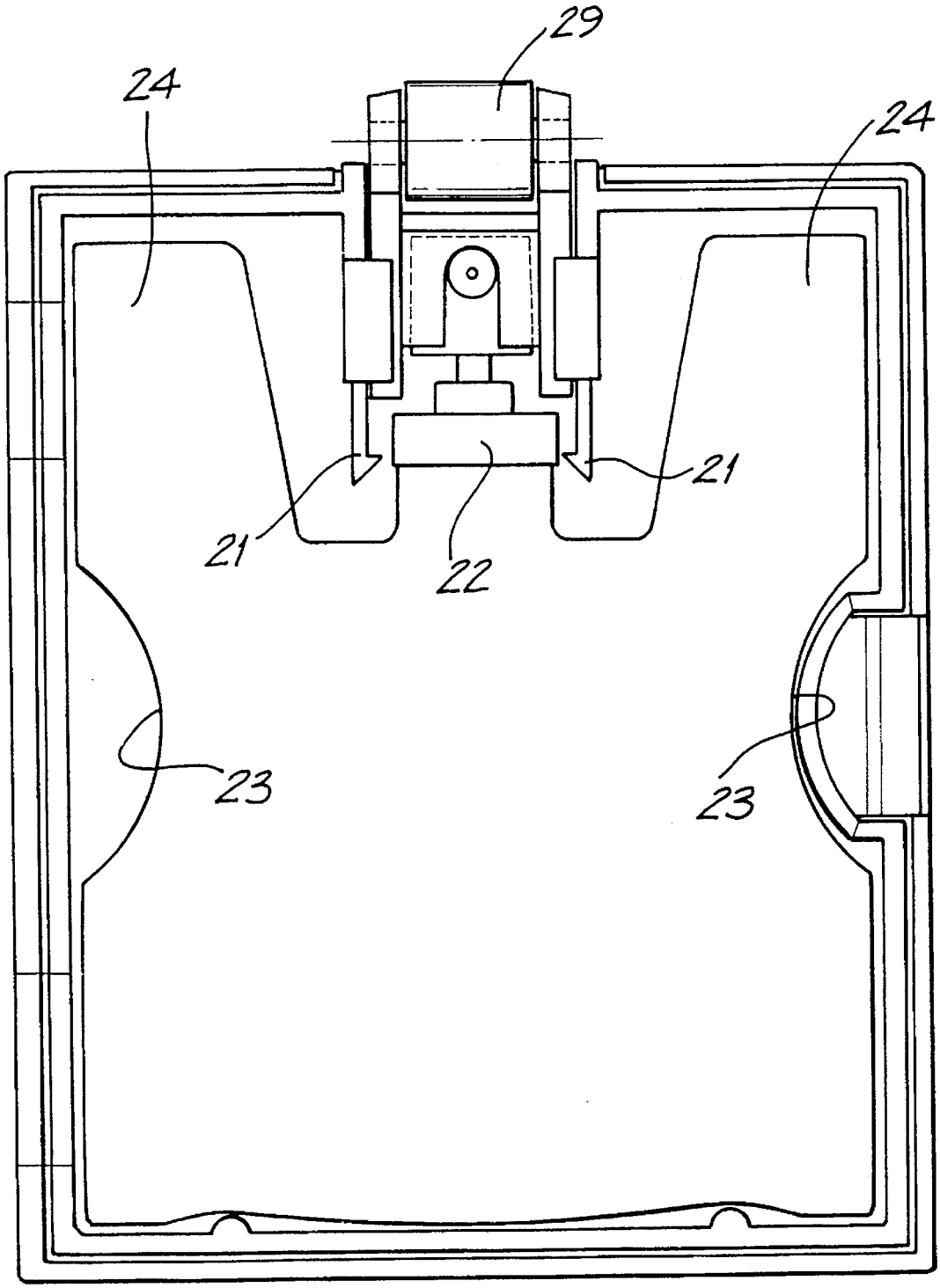
FIG. 4 is a front view of another door actuated device embodied by the present invention.

Container 6 of the embodiment illustrated in FIG. 4 is also provided with recesses 23 which provide thumb and fore finger placement positions when container 6 is grasped when being located in casing body 3. The container also has wing portions 24 which enable the volume of fluid able to be held by the container to be increased. If desired, one wing portion 24 may have a removable cap enabling the fluid in the container to be topped up after periods of use. In other embodiments, cap 22 of container 6 through which valve stem 9 protrudes is removable to allow filling of the container with fluid.

Figure 5A:
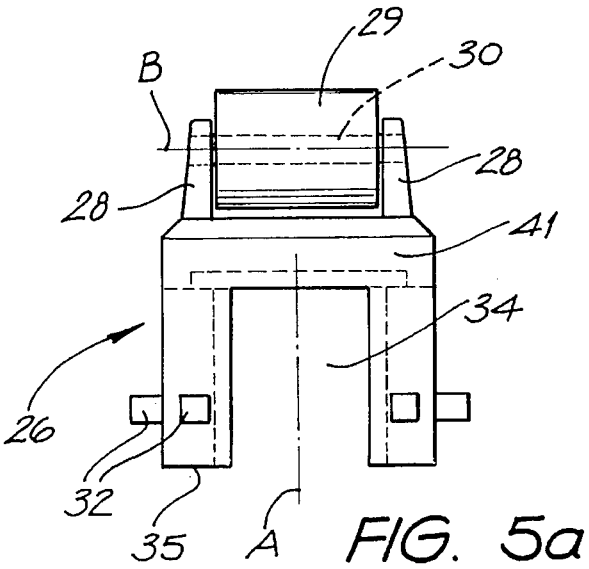
FIG. 5*a* is a front view of a plunger assembly of an embodiment of the present invention.
Figure 5B:
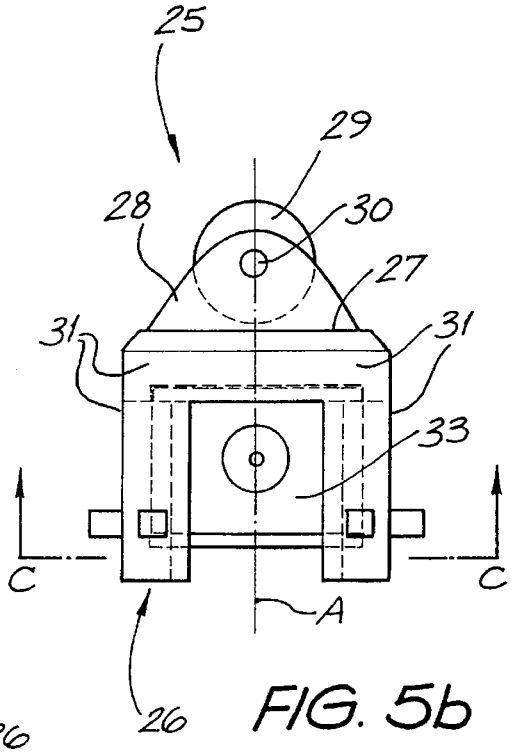
FIG. 5*b* is a side view of the plunger assembly of FIG. 5*a* having a press button located therein.
Figure 5C:
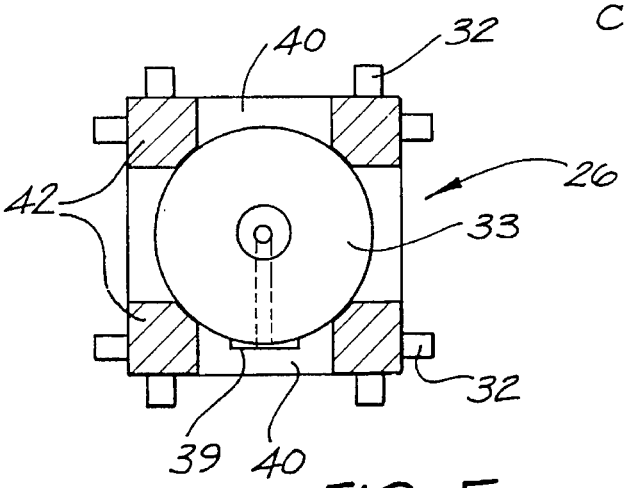
FIG. 5*c* is a cross-sectional view taken along line C—C of FIG. 5*b*.

The dispensing device 1 further comprises a plunger assembly 25 which is slidably received between guide walls 17 of casing body 3 and has a longitudinal axis A. Plunger assembly 25 depicted in FIGS. 5*a* to 5*c* is comprised of a plunger body 26 with a square shaped cress-section lying in a plane substantially perpendicular to longitudinal axis A. Plunger body 26 is provided on an upper face 27 with a pair of support flanges 28 which support an engagement roller 29 thereinbetween by means of an axle 30 (rotation axis B) orientated substantially perpendicularly to longitudinal axis A.

The dimensions of plunger assembly 25 are such that it can be received between the inner faces of guide walls 17 in a sliding fit. To further enhance guidance of plunger assembly 25 within casing body 3, plunger body 26 is provided on each side face 31 with two guide pins 32 which are received in corresponding guide grooves 18 in respective guide walls 17.

Since guide grooves 18 do not extend to the lower free end of guide walls 17 or to cop wall 14 of casing body 3, plunger assembly 25 cannot be inadvertently removed from between guide walls 17 in the direction of longitudinal axis A once guide pins 32 are inserted into guide grooves 18 via respective insertion grooves 19.

The upper and lower ends of guide grooves 18, together with guide pins 32 therefore act as retention and stop means for plunger assembly 25 and accordingly confine the displacement of plunger assembly 25 to an amount determined by the length of guide grooves 18.

It is, of course, possible to provide open ended guide grooves 18 in which case insertion grooves 19 in each guide wall 17 are superfluous and other suitable retention means can be provided in order to secure plunger assembly 25 against unintentional removal from casing body 3. For example, guide walls 17 may be provided with hook shaped extensions 21 which prevent plunger assembly 25 from falling from the passageway formed by guide walls 17 when container 6 is removed as shown in FIG. 4.

Moreover, the guiding of plunger assembly 25 within casing body 3 can be effected, for instance, solely by cooperation of two opposite faces 31 of plunger body 26 and the inner surfaces of the oppositely lying planar guide walls 17 of casing body 3 (or, alternatively, by three side faces 31 of the plunger body 26 in cooperation with guide walls 17 and back wall 11 of casing body 3).

As plunger body 26 has a square cross-section it can be received between guide walls 17 in two different rotational positions about longitudinal axis A. That is, the axis of rotation B of engagement roller 29, which lies in a plane substantially perpendicular to the longitudinal axis A, can be rotated in that plane by 90° from one position into another.

The plunger assembly 25 further includes press button 33 (FIG. 6) which is removably received in a correspondingly shaped cavity 34 in plunger body 26 that opens onto a bottom face 35 thereof. Alternatively, press button 33 may be removably received within plunger body 26 between protrusions 36 which extend from inner surfaces of side faces 31 of plunger body 26 as shown in FIG. 7.

Press button 33 is able to be rotated about longitudinal axis A of plunger body 26 and is provided on its underside with a receptacle opening 37 adapted to receive valve stem 9 of container 6. A duct 38 extends from receptacle opening 37 and terminates in a suitably formed nozzle 39.

Figure 6:
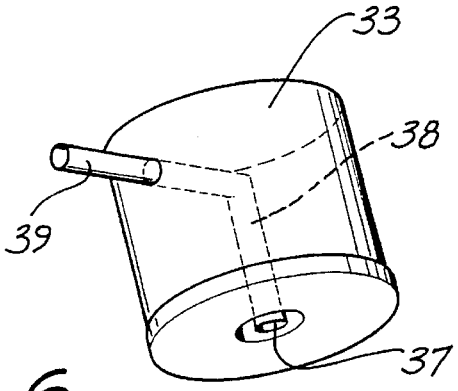
FIG. 6 is a perspective view of another press button for use in the plunger body of FIG. 5*a*.
Figure 7:
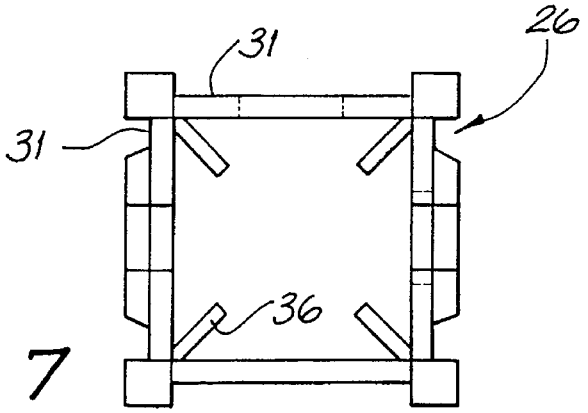
FIG. 7 is a bottom view of a plunger body of a plunger assembly of yet a further embodiment of the present invention.

Nozzle 39 may be formed by a conduit extending from the peripheral side face of the press button 33 as is illustrated in FIG. 6, or as a simple, integrally formed nozzle opening as depicted in FIG. 5*c*. The nozzle is adapted to create a fine spray mist and to avoid formation of larger fluid droplets.

Plunger body 26 is provided with suitably shaped openings 40 in at least two side faces 31 which communicate with cavity 34 so as to allow fluid from the container to be dispensed from nozzle 39. Preferably, each side face 31 of plunger body 26 is provided with an opening 40 as shown in FIGS. 5*a* to 5*c*.

Accordingly, plunger body 26 actually consists of a top portion 41 from which four leg-like extensions 42 protrude downwardly. This configuration allows press button 33 to be received within cavity 34 in rotational positions about the longitudinal axis A that allow dispensing of fluid from nozzle 39 within a fan-like sector through any one of openings 40.

Since the fluid is dispensed substantially perpendicularly to longitudinal axis A of plunger assembly 25, cover 4 of casing body 3 is also provided with an aperture 43. The size of aperture 43 is determined by the length of the downward stroke of plunger assembly 25 within casing body 3 and the dispensing angle capable of being achieved due to rotational movement of press button 33 between extensions 42 of plunger body 26.

Figure 8A:
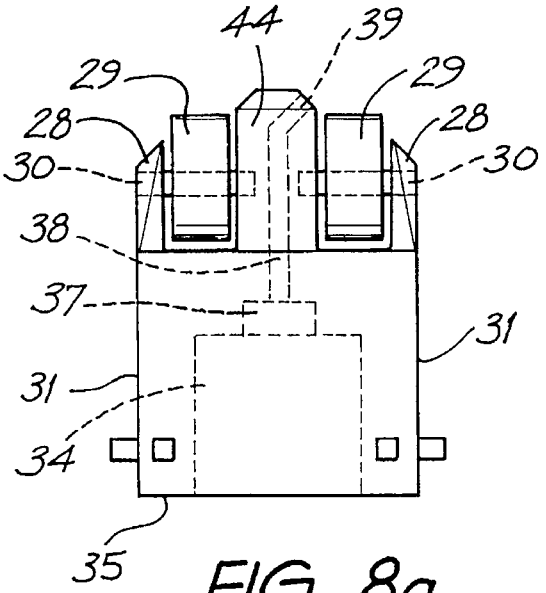
FIG. 8*a* is a front view of a plunger assembly of still another embodiment of the present invention. A side view and a bottom view of the plunger assembly of FIG. 8*a* is shown in FIGS. 8*b* and 8*c*, respectively
Figure 8B:
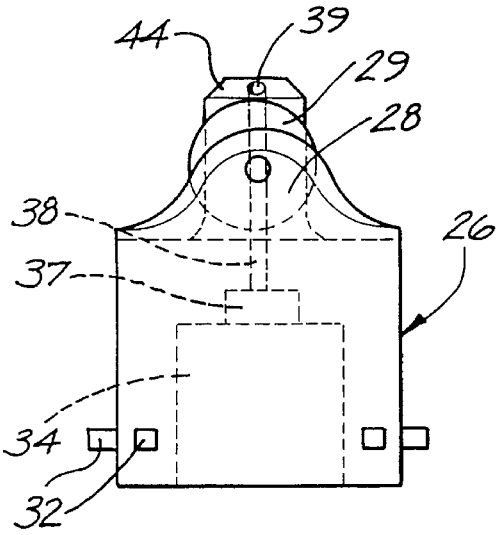
Figure 8C:
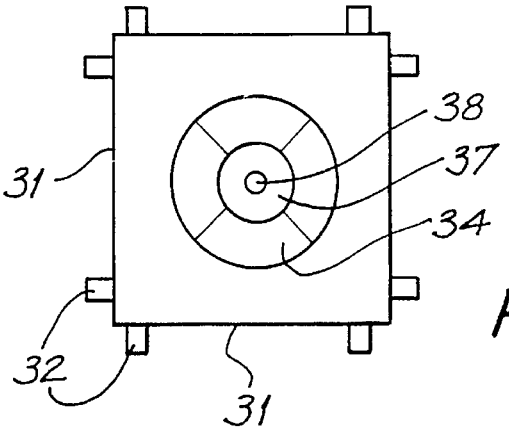

An alternate of plunger assembly 25 which allows fluid to be dispensed from the top side thereof is shown in FIGS. 8*a* to 8*c*. For explanatory purposes, the same reference numerals will be used to refer to functionally equivalent or similar features and elements described in relation to FIGS. 5*a* to 5*c*.

Plunger body 26 illustrated in FIG. 8*a* is integrally provided on its upper surface with two support flanges 28 in between which is located a central flange portion 44. A pair of engagement rollers 29 are rotatably supported between central flange 44 and support flanges 28. Axles 30 of engagement rollers 29 are co-axial to one another, are orientated perpendicularly to longitudinal axis A and extend substantially parallel to opposing faces 31 of plunger body 26.

Within plunger body 26 extends a duct 38 which originates in receptacle opening 37 adapted to receive valve stem 9 of container 6 and which terminates in a suitably formed nozzle 39 in central flange portion 44. Receptacle opening 37 is provided at the end of a cylindrical cavity 34 which is opened to bottom surface 35 of plunger body 26. The diameter of cavity 34 is such as to allow reception of an upper region of dispenser valve assembly 7 when plunger body 26 is displaced downwardly.

As indicated in FIG. 8*a* duct 38 and nozzle 39 are angled transversely with respect to longitudinal axis A of plunger assembly 25. However, nozzle 39 can be orientated so as to allow fluid to be dispensed substantially perpendicular to longitudinal axis A of plunger assembly 25 if desired. Accordingly, the direction in which the fluid is dispensed from nozzle 39 can be changed by rotating plunger assembly 25 between different rotational positions about longitudinal axis A.

It will be appreciated by the skilled addressee that casing body 3 need not be provided with an opening 43 in cover 4 when nozzle 39 is located on the upper face of plunger body 26.

In order to assemble dispensing device 1 plunger assembly 25 is positioned in casing body 3 by inserting guide pins 32 on opposite faces 31 of plunger body 26 in corresponding insertion grooves 19. When guide pins 32 align with respective guide grooves 18 in guide walls 17 plunger assembly 25 is moved in an upward direction causing engagement roller(s) 29 to protrude though opening 16 of casing body 3.

The rotational position in which plunger assembly 25 is inserted in casing body 3 will depend on the door type on which the device is to be mounted. If dispensing device 1 is to be mounted to a swing door than rotational axis B of engagement roller 29 will be orientated so as to be substantially parallel to the face of the door on which the device is mounted. However, if dispensing device 1 is to be mounted to a sliding door rotational axis B of engagement roller 29 will be orientated substantially perpendicularly to the face of the door.

Once plunger assembly 25 is located in casing body 3 a suitably formed container 6 is inserted. The neck 10 of container 6 is positioned between substantially parallel guide walls 17 and may even extend into cavity 34 of plunger body 26. Valve stem 9 of container 6 is received in receptacle opening 37 of press button 33 (or plunger body 26 as shown in FIGS. 8*a* to 8*c*) so that fluid communication is established between nozzle 39 of plunger assembly 25 and the interior of container 6.

Dispensing valve assembly 7 of container 6 is provided with a spring 46 to effect the return of valve stem 9 after having been depressed in order to effect the dispensing of the fluid from the container. It is not necessary to provide a separate spring for plunger assembly 25 in order to return the later to its original position as valve stem 9 itself presses against press button 33 driving it upwardly once the force which effected the displacement of plunger assembly 25 and valve stem 9 has been removed.

However, a further spring can be provided between plunger body 26 and neck 10 of container 6, or between plunger body 26 and guide walls 17 to assist in the return a plunger assembly 25 to its original position if desired.

The dimensions and arrangement of plunger body 26, press button 33 guide walls 17, neck 10 of container 6 and valve stem 9 with respect to one another are such that engagement roller 29 of plunger assembly 25 protrudes through opening 16 in top wall 14 of casing body 3 when not depressed.

Plunger assembly 25 is able to be depressed to such an extent so as to provide a sufficiently large displacement of valve stem 9 to allow dispensing valve assembly 7 to dispense a amount of fluid suitable for effecting deodorising of the area surrounding dispensing device 1.

The actual displacement of plunger assembly 25 is achieved by contact of engagement roller 29 with a suitably formed ramp fitting remotely located from casing 2 as will now be described.

Figure 9A:
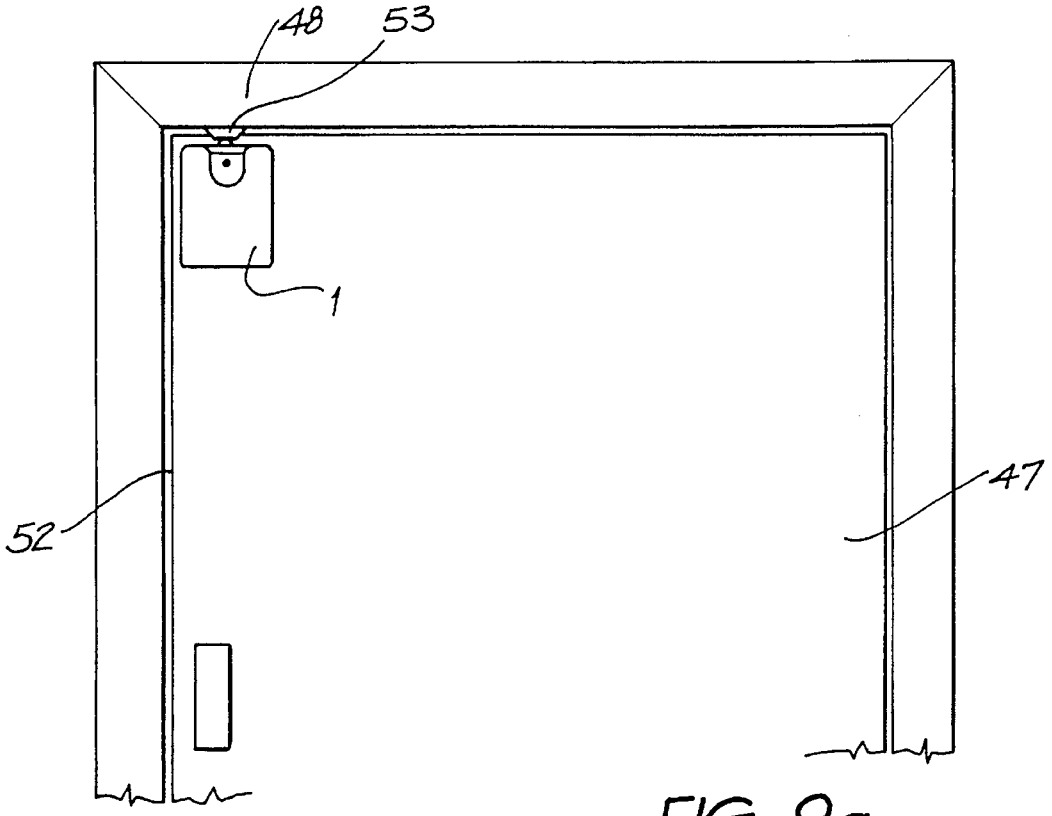
FIGS. 9*a* and 9*b* show dispensing devices embodied by the present invention mounted to a swinging door and a sliding door, respectively.
Figure 9B:
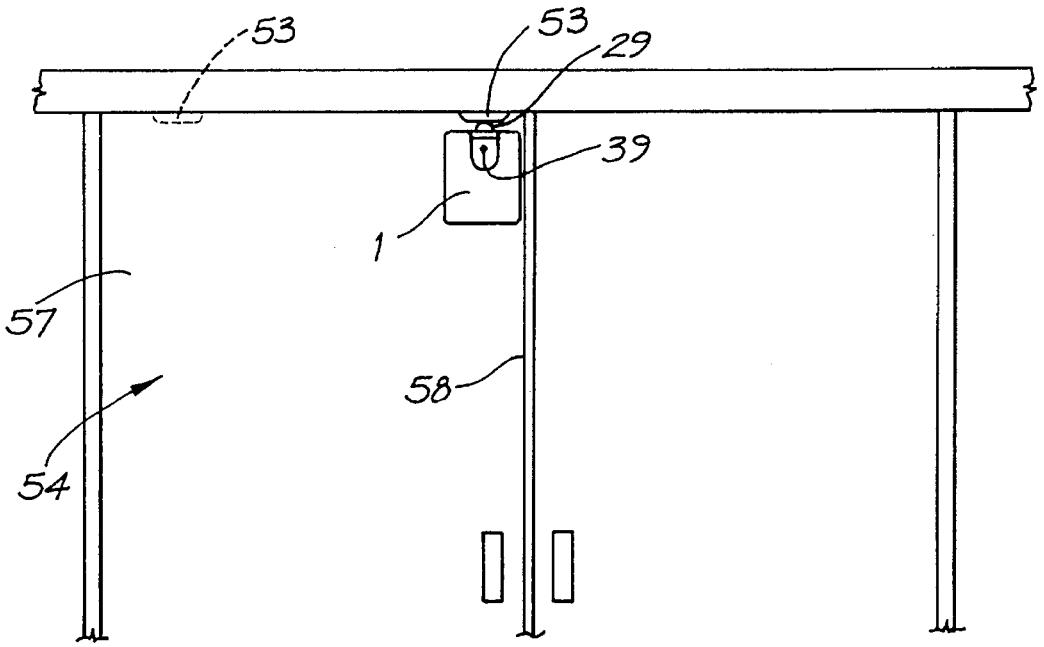
Figure 9C:
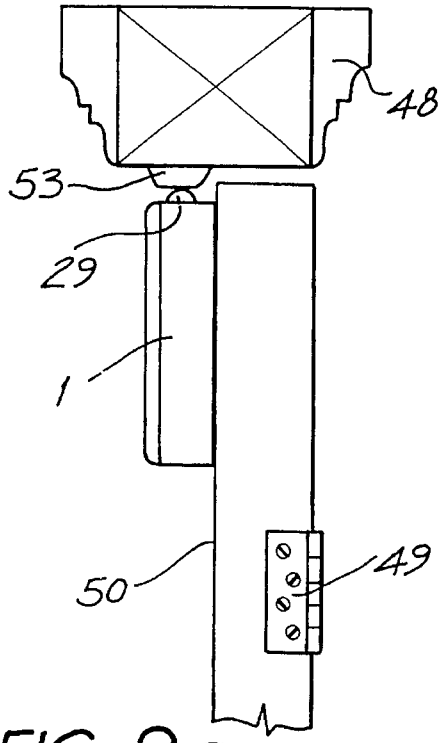
FIGS. 9*c* and 9*d* are cross-sectional views of a swinging door and the architrave thereof, and two possible mounting positions for the holder.
Figure 9D:
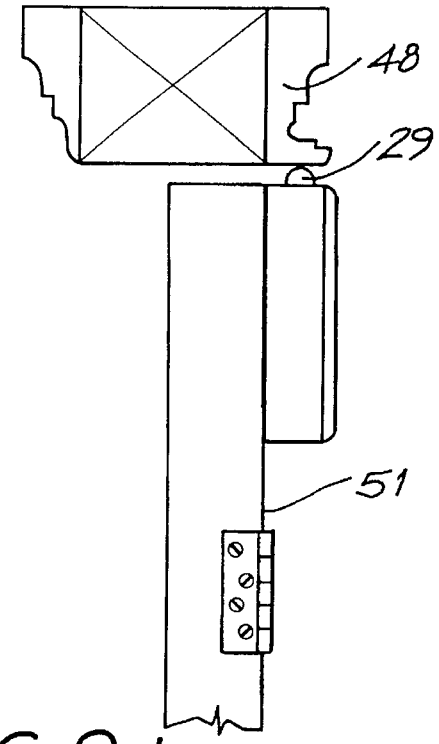
Figure 9E:
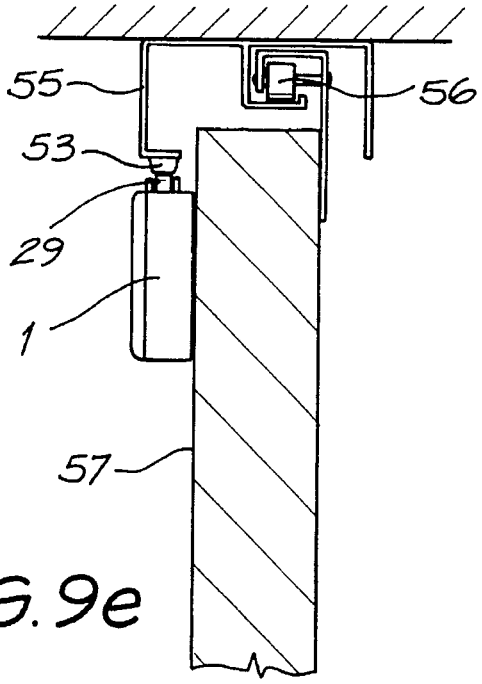
FIG. 9*e* is a partial cross-sectional view of a sliding door having the dispensing device of FIG. 9*b* mounted thereto.

FIGS. 9*a*, 9*c* and 9*d* show dispensing device 1 mounted to a swing door 47 pivotally supported at one side thereof from a door frame 48 in a known manner by conventional hinge mountings 49. The device is located on side face 50 or 51 of door 47 near the free upper end corner thereof by means of screws inserted through mounting holes 15 in back wall 23 of casing body 3 such that longitudinal axis A of plunger assembly 25 is substantially parallel to a side edge 52 of door 47.

A suitably formed ramp fitting or bracket 53 with inclined contact surfaces is mounted on door frame 48 so as to be able to engage with engagement roller 29 and thereby cause plunger assembly 25 to be depressed relative to casing 2 when door 47 is closed.

FIGS. 9*c* and 9*d* illustrate how ramp fitting 53 and dispensing device 1 may be arranged in order to cater for different opening directions of door 47.

Ramp fitting 53 need not be mounted to door frame 48 but can instead be an integral part thereof having an inclined surface facing plunger assembly 25 in order to allow contact with engagement roller 29 and subsequent progressive displacement of plunger assembly 25 as a whole when the door is closed or opened.

FIGS. 9*b* and 9*c* show dispensing device 1 mounted to a cavity type sliding door 54 supported from and guided on an overhead rail 55 using roller carriages 56. Sliding door 54 is also guided by a floor rail (not shown). Casing 2 of dispensing device 5 is mounted on an upper end corner of side face 57 of door 54 using a double-sided adhesive nape provided on back wall 11 of casing body 3. The device is arranged so that longitudinal axis A of plunger assembly 25 is substantially parallel with side edge 58 of door 54.

Ramp fitting 53 is mounted on overhead rail 55 in a location to enable engagement with engagement roller 29 and subsequent depressing of plunger assembly 25 upon opening and/or closing of door 54.

If desired, a further ramp fitting 53 can be located on rail 55 (as indicated in phantom in FIG. 9*b*) to effect double actuation of plunger assembly 25 and subsequent double dispensing of deodoriser fluid from dispensing device 1 whenever door 54 is opened and closed.

It is, of course, also possible to mount dispensing device 1 in an inverted position on door frame 48 or overhead rail 55 and to locate ramp fitting 53 on the door in a position to cause plunger assembly 25 to be depressed when the door reaches and opened or closed position.

Figure 10:
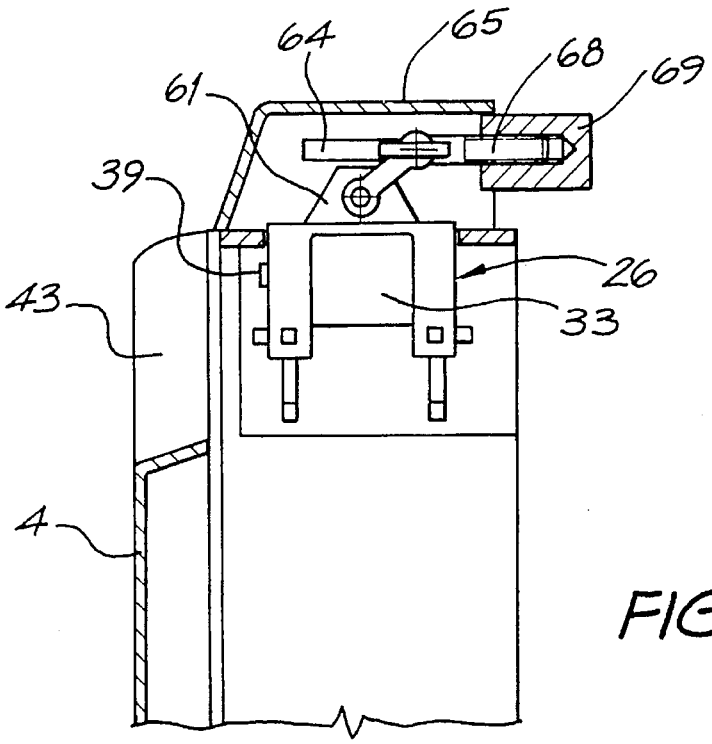
FIG. 10 is a partial cross-sectional side view of another plunger assembly of an embodiment of the present invention having a linkage arrangement.
Figure 11:
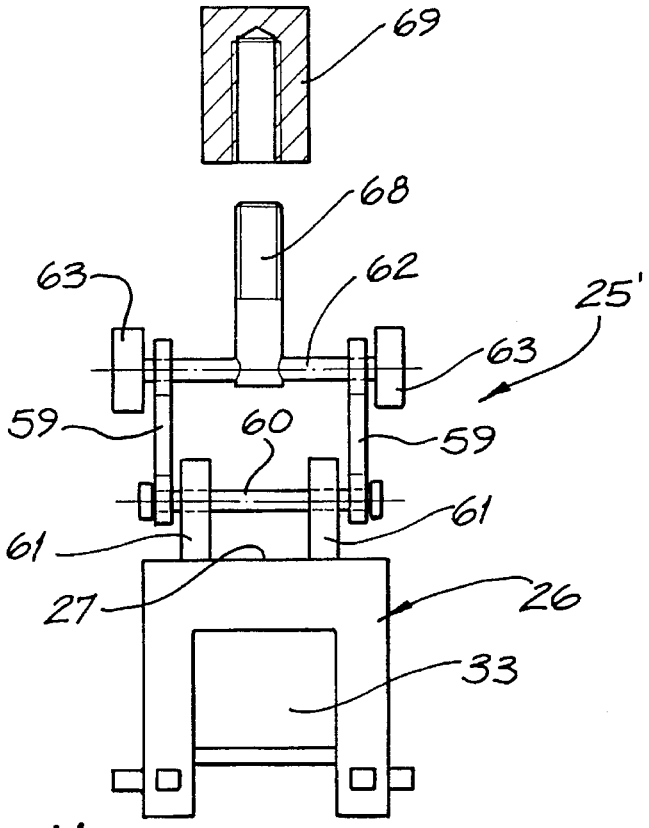
FIG. 11 is a front view of the plunger assembly of FIG. 10.

FIGS. 10 and 11 show a further embodiment of the present invention wherein plunger assembly 25' has a linkage arrangement adapted to transform a horizontal force into a vertical force in order to cause plunger assembly 25' to be depressed.

The linkage and arrangement comprises two levers 59 pivotally connected at one end to an axle 60 supported by side flanges 61 on upper face 27 of plunger body 26. The other ends of levers 59 are pivotally connected to a guide bar 62 which lies substantially parallel with axle 60. Terminal ends 63 of guide bar 62 are located in form corresponding guide slots 64 provided in substantially parallel opposite side walls of housing 65 comprising a further part of casing 2 and which extend in a direction substantially perpendicular to longitudinal axis A of plunger assembly 25'.

Housing 65 is U-shaped in cross-section and is secured to top wall 14 of casing body 3 by flanges protruding from the side walls of housing 65 that are received in grooves 66 of protrusions 67 (shown in FIG. 3) Of casing body 3.

Guide bar 62 is provided with an integrally formed contact rod 68 extending perpendicularly therefrom and which is provided with an externally threaded terminal end portion which is received in a threaded bore of cylindrical contact body 69. The threaded inter-engagement allows the extent to which contact body 69 protrudes from contact rod 68 to be adjusted.

This embodiment of the present invention may also be used with both swing doors and sliding doors. In the later case housing 65 is secured to top wall 14 of casing body 3 by the receipt of the flanges protruding from the side walls of housing 65 in grooves (non shown) in profusions 67 which extend perpendicularly to grooves 66.

Actuation of dispensing device 1 may in both cases be effected when connect body 69 is pressed against a wall, fitting or door frame upon closing the door. The displacement of contact body 69 causes terminal ends 63 of guide bar 62 to be driven along guide slots 64 which forces levers 59 into a substantially horizontal position and causes plunger body 26 to be depressed in the passageway formed by guide walls 17 resulting in fluid being dispensed from container 6.

Casing body 2 can be formed from any suitable plastic of duroplastic resin, preferably using injection moulding techniques. If desired, plunger body 26, press button 33 and engagement roller 29 can be formed from the same material as casing 2. However, a reinforced thermoplastic material such as polyamide can also be used to increase wear resistance of the engagement surfaces of plunger body 26 and engagement roller 29.

Guide pins 32 on plunger body 26 can be integrally formed therewith or may, for instance, be metal pins that are inserted into holes provided in side faces 31 of plunger body 26. The axle 30 of engagement roller 29 as well as levers 59, contact rod 68 and guide bar 62 of the embodiment illustrated in FIGS. 10 and 11 are preferably formed from stainless steel or other high strength materials.

Although the present invention has been described hereinbefore with reference to several embodiments, numerous variations and modifications are possible without departing from the scope of the invention which is defined in the following claims.

For example, the cross-section of plunger body 26 of plunger assembly 25 need not be square shaped but may be, for example, hexagonal, octagonal or circular in shape in which case the surfaces of guide walls 17 of casing body 3 are form-correspondingly adapted to allow secure reception of plunger assembly 25 therein in a plurality of different rotational positions about its longitudinal axis.

The claims defining the invention are as follows:

1. A door actuated device for dispensing a fluid from a container, comprising:

a holder receiving the container and being mountable to a door or a structure adjacent to the door; and a plunger assembly for actuating a dispensing means of the container and being displaceable between first and second positions relative to the container, the plunger assembly having a longitudinal axis and contact means arranged to be able to contact a foreign surface when the door is opened and/or closed and so cause the plunger assembly to be displaced;

wherein the holder has guide means for guiding the plunger assembly between the first and second positions and the fluid is dispensed from the container by the dispensing means through a nozzle on the plunger assembly when the plunger assembly is displaced by the contact of the contact means with the foreign surface, and wherein the plunger assembly is able to be slidably received by the guiding means of the holder in a plurality of different rotational positions obtainable by rotating the plunger assembly about the longitudinal axis.

2. A door actuated device according to claim 1 wherein the contact means is able to be orientated in any one of a number of possible directions by rotating the plunger assembly between the different rotational positions.

3. A door actuated device according to claim 2 wherein the contact means is rotated through 90° when the plunger assembly is rotated from a first said rotational position to a second said rotational position.

4. A door actuated device according to claim 2 wherein the contact means comprises at least one roller having an axis of rotation substantially perpendicular to the longitudinal axis of the plunger assembly.

5. A door actuated device according to claim 2 wherein the contact means is connected to the plunger assembly through a linkage arrangement.

6. A door actuated device according to claim 5 wherein the linkage arrangement comprises at least one lever pivotally connected to a guide bar at one end and an axle at an opposite end which is rotatably mounted to a plunger body of the plunger assembly, and wherein opposite end regions of the guide bar are slidably received in guide slots formed in a portion of the holder and the plunger body is displaced from the first position to the second position by movement of the at least one lever when the end regions of the guide bar are driven along the guide slots by the contact of the contact means with the foreign surface.

7. A door actuated device according to claim 2 wherein the plunger assembly is comprised of a plunger body and a plunger button received in a cavity of the plunger body, and wherein the nozzle is located on the plunger button and the plunger body is able to be rotated between the different rotational positions relative to the plunger button.

8. A door actuated device according to claim 7 wherein the nozzle is orientated substantially perpendicularly to the longitudinal axis of the plunger assembly.

9. A door actuated device according to claim 7 wherein the plunger body has a substantially square or octagonal shaped cross-section lying in a plane perpendicular to the longitudinal axis of the plunger assembly.

10. A door actuated device according to claim 2 wherein the plunger assembly comprises a plunger body on which the nozzle is located, and wherein the nozzle is connected to the dispensing means of the container through a duct formed in the plunger body.

11. A door actuated device according to claim 10 wherein the plunger body has a substantially square or octagonal shaped cross-section lying in a plane perpendicular to the longitudinal axis of the plunger assembly.

12. A door actuated device according to claim 10 wherein the nozzle is substantially coaxial or is orientated so as to be substantially parallel with the longitudinal axis of the plunger assembly.

13. A door actuated device according to claim 12 wherein the nozzle is located on an upper surface of the plunger body on which the contact means is arranged.

14. A door actuated device according to claim 10 wherein the nozzle is angled transversely with respect to the longitudinal axis of the plunger assembly.

15. A door actuated device according to claim 14 wherein the nozzle is located on an upper surface of the plunger body on which the contact means is arranged.

16. A door actuated device according to claim 2 wherein the guide means comprises two guide walls extending from an inner surface of the holder and forming a passageway in which the plunger assembly is slidably received.

17. A door actuated device according to claim 16 wherein each said guide wall has a flange for maintaining the plunger assembly within the passageway.

18. A door actuated device according to claim 16 wherein a plurality of protrusions extend from the plunger assembly and are received in channels formed in the guide walls of the housing, and wherein the channels are substantially parallel with the longitudinal axis of the plunger assembly.

19. A door actuated device according to claim 18 wherein each of the guide walls have a groove for receiving corresponding said protrusions and enabling the protrusions to be located in the respective said channels.

* * * * *